US006155674A

United States Patent [19]

Figueredo et al.

[11] Patent Number: 6,155,674

[45] Date of Patent: Dec. 5, 2000

[54] STRUCTURE TO EFFECT ADHESION BETWEEN SUBSTRATE AND INK BARRIER IN INK JET PRINTHEAD

[75] Inventors: Domingo A Figueredo, Livermore, Calif.; Gregory T Hindman, Albany, Oreg.; Brian J Keefe, La Jolla; Ali Emamjomeh, San Diego, both of Calif.; Roger J Kolodziej, Corvallis, Oreg.; Grant Allen Webster, Valley Center; Terri I. Chapman, Escondido, both of Calif.

[73] Assignee: Hewlett-Packard Company, Palo Alto, Calif.

[21] Appl. No.: 08/811,404

[22] Filed: Mar. 4, 1997

[51] Int. Cl.[7] ..... B41J 2/05

[52] U.S. Cl. ..... 347/63

[58] Field of Search ..... 347/63, 64, 65

[56] References Cited

U.S. PATENT DOCUMENTS

| | | | |
|---|---|---|---|
| 4,596,994 | 6/1986 | Matsuda | 346/140 R |
| 4,719,477 | 1/1988 | Hess | 347/59 |
| 4,792,818 | 12/1988 | Eldridge et al. | 347/63 |
| 5,136,310 | 8/1992 | Drews | 347/45 |
| 5,278,584 | 1/1994 | Keefe . | |
| 5,317,346 | 5/1994 | Garcia . | |
| 5,469,199 | 11/1995 | Allen | 347/42 |
| 5,635,968 | 6/1997 | Bhaskar et al. | 347/59 |

FOREIGN PATENT DOCUMENTS

| | | | |
|---|---|---|---|
| 0317171 | 5/1989 | European Pat. Off. | B41J 3/04 |
| 0475235 | 3/1992 | European Pat. Off. | B41J 2/205 |
| 0490668 | 6/1992 | European Pat. Off. | B41J 2/16 |
| 0593133 | 4/1994 | European Pat. Off. | B41J 2/16 |
| 5-238011 | 9/1993 | Japan . | |

OTHER PUBLICATIONS

"Development Of The Thin–Film Structure For The Think-Jet Printhead," Bhaskar & Aden, Hewlett–Packard Journal, vol. 36, No. 5, May 1985, pp. 27–33.

"Development Of A High–Resolution Thermal Inkjet Printhead," Buskirk, Hackleman, Hall, Kanarek, Low, Trueba, Van de Poll, Hewlett–Packard Journal, vol. 39, No. 5, Oct. 1988, pp. 55–61.

"The Third–Generation HP Thermal InkJet Printhead," Aden, Bohorquez, Collins, Crook, Garcia & Hess, Hewlett–Packard Journal, vol. 45, No. 1, Feb. 1994, pp. 41–45.

"Developement of the Thin–film Structure For the ThinkJet Printhead," Bhaskar & Aden, Hewlett–Packard Journal, vol. 36, No. 5, May 1985, pp. 27–33, May 1995.

Copy of EPO Search Report, dated Jun. 15, 1998, from application EP 97 12 0951.

Copy of EPO Search Report, dated Jun. 15, 1998, from application EP 97 12 0952.

*Primary Examiner*—John Barlow
*Assistant Examiner*—Juanita Stephens
*Attorney, Agent, or Firm*—Manuel Quiogue

[57] ABSTRACT

A thermal ink jet printhead that includes an adhesion interface between a silicon carbide layer of a thin film substrate and a polymer ink barrier layer in the vicinity of ink chambers formed in the polymer ink barrier layer, and an adhesion interface between a silicon carbide layer disposed on the ink barrier layer and an orifice plate. An intervening adhesion promoter can be located between the silicon carbide layer of the thin film substrate and the polymer ink barrier layer, and between the silicon carbide layer disposed on the ink barrier layer and the orifice plate.

27 Claims, 6 Drawing Sheets

STRUCTURE TO EFFECT ADHESION BETWEEN SUBSTRATE AND INK BARRIER IN INK JET PRINTHEAD

This application relates to the subject matter disclosed in commonly assigned copending U.S. application Ser. No. 08/811,403, filed herewith on Mar. 4, 1997, entitled "TRANSITION METAL CARBIDE FILMS FOR APPLICATIONS IN INK JET PRINTHEADS", which is incorporated herein by reference.

BACKGROUND OF THE INVENTION

The subject invention generally relates to ink jet printing, and more particularly to a thin film ink jet printheads for ink jet cartridges and methods for manufacturing such printheads.

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (October 1988); Vol. 43, No. 4 (August 1992); Vol. 43, No. 6 (December 1992); and Vol. 45, No. 1 (February 1994); all incorporated herein by reference.

Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice plate that is attached to an ink barrier layer which in turn is attached to a thin film substructure that implements ink firing heater resistors and apparatus for enabling the resistors. The ink barrier layer defines ink channels including ink chambers disposed over associated ink firing resistors, and the nozzles in the orifice plate are aligned with associated ink chambers. Ink drop generator regions are formed by the ink chambers and portions of the thin film substructure the orifice plate that are adjacent the ink chambers.

The thin film substructure is typically comprised of a substrate such as silicon on which are formed various thin film layers that form thin film ink firing resistors, apparatus for enabling the resistors, and also interconnections to bonding pads that are provided for external electrical connections to the printhead. The thin film substructure more particularly includes a top thin film layer of tantalum disposed over the resistors as a thermomechanical passivation layer.

The ink barrier layer is typically a polymer material that is laminated as a dry film to the thin film substructure, and is designed to be photodefinable and both UV and thermally curable.

An example of the physical arrangement of the orifice plate, ink barrier layer, and thin film substructure is illustrated at page 44 of the *Hewlett-Packard Journal* of February 1994, cited above. Further examples of ink jet printheads are set forth in commonly assigned U.S. Pat. No. 4,719,477 and U.S. Pat. No. 5,317,346, both of which are incorporated herein by reference.

Considerations with the foregoing ink jet printhead architecture include delamination of the orifice plate from the ink barrier layer, and delamination of the ink barrier layer from the thin film substructure. Delamination principally occurs from environmental moisture and the ink itself which is in continual contact with the edges of the thin film substructure/barrier interface and the barrier/orifice plate interface in the drop generator regions.

It has been determined that the tantalum thermomechanical passivation layer offers the additional functionality of improving adhesion to the ink barrier layer. However, while the barrier adhesion to tantalum has proven to be sufficient for printheads that are incorporated into disposable ink jet cartridges, barrier adhesion to tantalum is not sufficiently robust for semipermanent ink jet printheads which are not replaced as frequently. Moreover, new developments in ink chemistry have resulted in formulations that more aggressively debond the interface between the thin film substructure and the barrier layer, as well as the interface between the barrier layer and the orifice plate.

In particular, water from the ink enters the thin film substructure/barrier interface and the barrier/orifice plate by penetration through the bulk of the barrier, penetration along the barrier, and in the case of a polymeric orifice plate by penetration through the bulk of the polymeric orifice plate, causing debonding of the interfaces through a chemical mechanism such as hydrolysis.

The problem with tantalum as a bonding surface is due to the fact that while the tantalum layer is pure tantalum when it is first formed in a sputtering apparatus, a tantalum oxide layer forms as soon as the tantalum layer is exposed to an oxygen containing atmosphere. The chemical bond between an oxide and a polymer film tends to be easily degraded by water, since the water forms a hydrogen bond with the oxide that competes with and replaces the original polymer to oxide bond, and thus ink formulations, particularly the more aggressive ones, debond an interface between a metal oxide and a polymer barrier.

SUMMARY OF THE INVENTION

It would therefore be an advantage to provide an improved ink jet printhead that reduces delamination of the interface between the thin film substructure and the ink barrier layer.

Another advantage would be to provide an improved ink jet printhead that reduces delamination of the interface between the ink barrier layer and the orifice plate.

A further advantage would be to provide in a ink jet printhead a bonding surface that provides bonding sites to which a polymer barrier layer can form a stable chemical bond.

The foregoing and other advantages are provided by the invention in an ink jet printhead that includes an adhesion interface between a silicon carbide layer of a thin film substrate and a polymer ink barrier layer in the vicinity of ink chambers formed in the polymer ink barrier layer, and an adhesion interface between a silicon carbide layer disposed on an orifice plate and the ink barrier layer. An intervening adhesion promoter can be located between the silicon carbide layer of the thin film substrate and the polymer ink barrier layer, and between the silicon carbide layer disposed on the ink barrier layer and the orifice plate.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
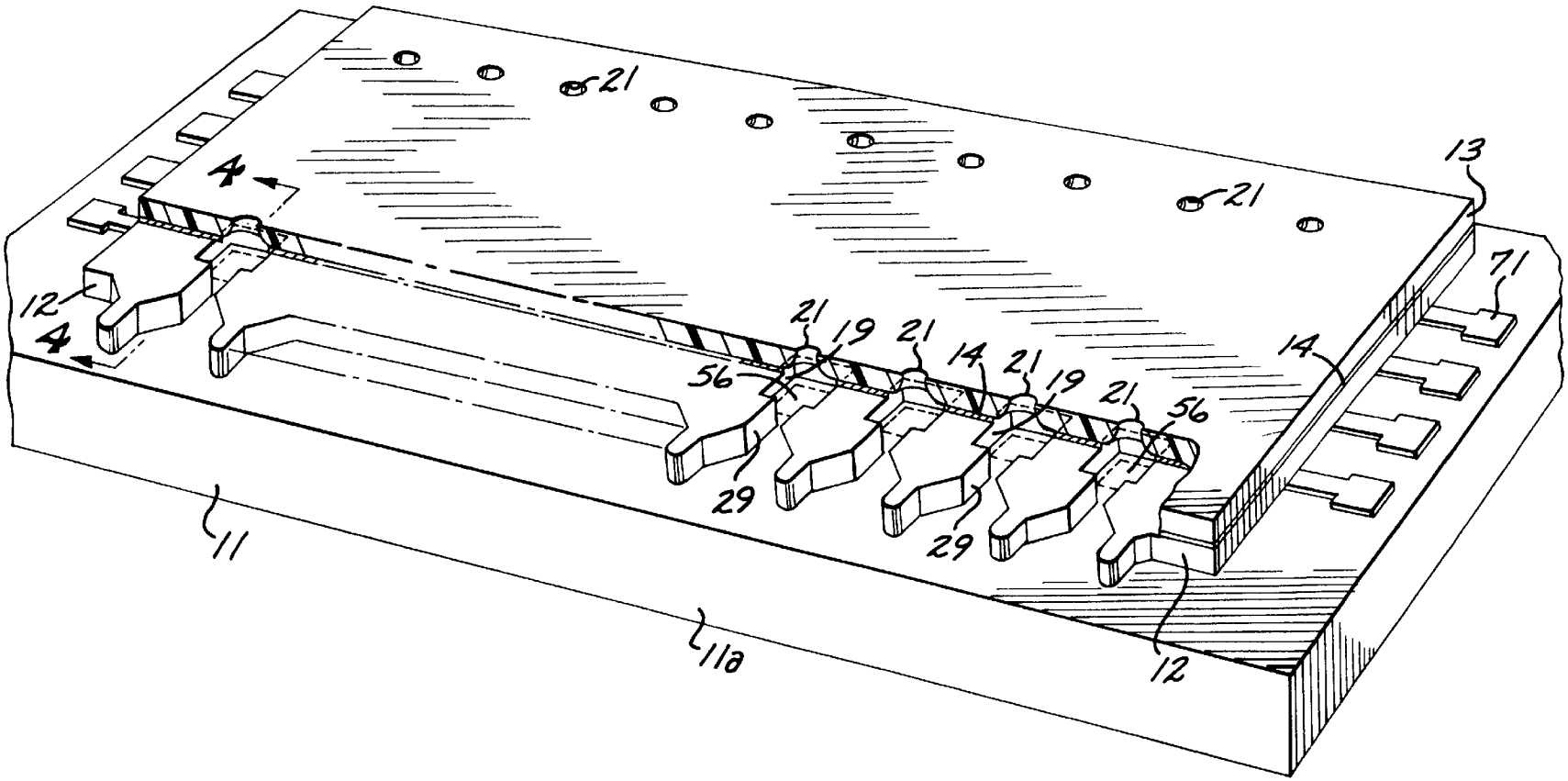
FIG. 1 is a schematic, partially sectioned perspective view of an ink jet printhead in accordance with the invention.

In the following detailed description and in the several figures of the drawing, like elements are identified with like reference numerals.

Referring now to FIG. 1, set forth therein is an unscaled schematic perspective view of air ink jet printhead in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 attached to the top of the ink barrier 12 with a carbide adhesion layer 14.

The thin film substructure 11 is formed pursuant to conventional integrated circuit techniques, and includes thin film heater resistors 56 formed therein. By way of illustrative example, the thin film heater resistors 56 are located in rows along longitudinal edges of the thin film substructure.

The ink barrier layer 12 is formed of a dry film that is heat and pressure laminated to the thin film substructure 11 and photodefined to form therein ink chambers 19 and ink channels 29 which are disposed over resistor regions which are on either side of a generally centrally located gold layer 62 (FIG. 2) on the thin film substructure 11. Gold bonding pads 71 engagable for external electrical connections are disposed at the ends of the thin film substructure and are not covered by the ink barrier layer 12. As discussed further herein with respect to FIG. 2, the thin film substructure 11 includes a patterned gold layer 62 generally disposed in the middle of the thin film substructure 11 between the rows of heater resistors 56, and the ink barrier layer 12 covers most of such patterned gold layer 62, as well as the areas between adjacent heater resistors 56. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

Figure 1A:
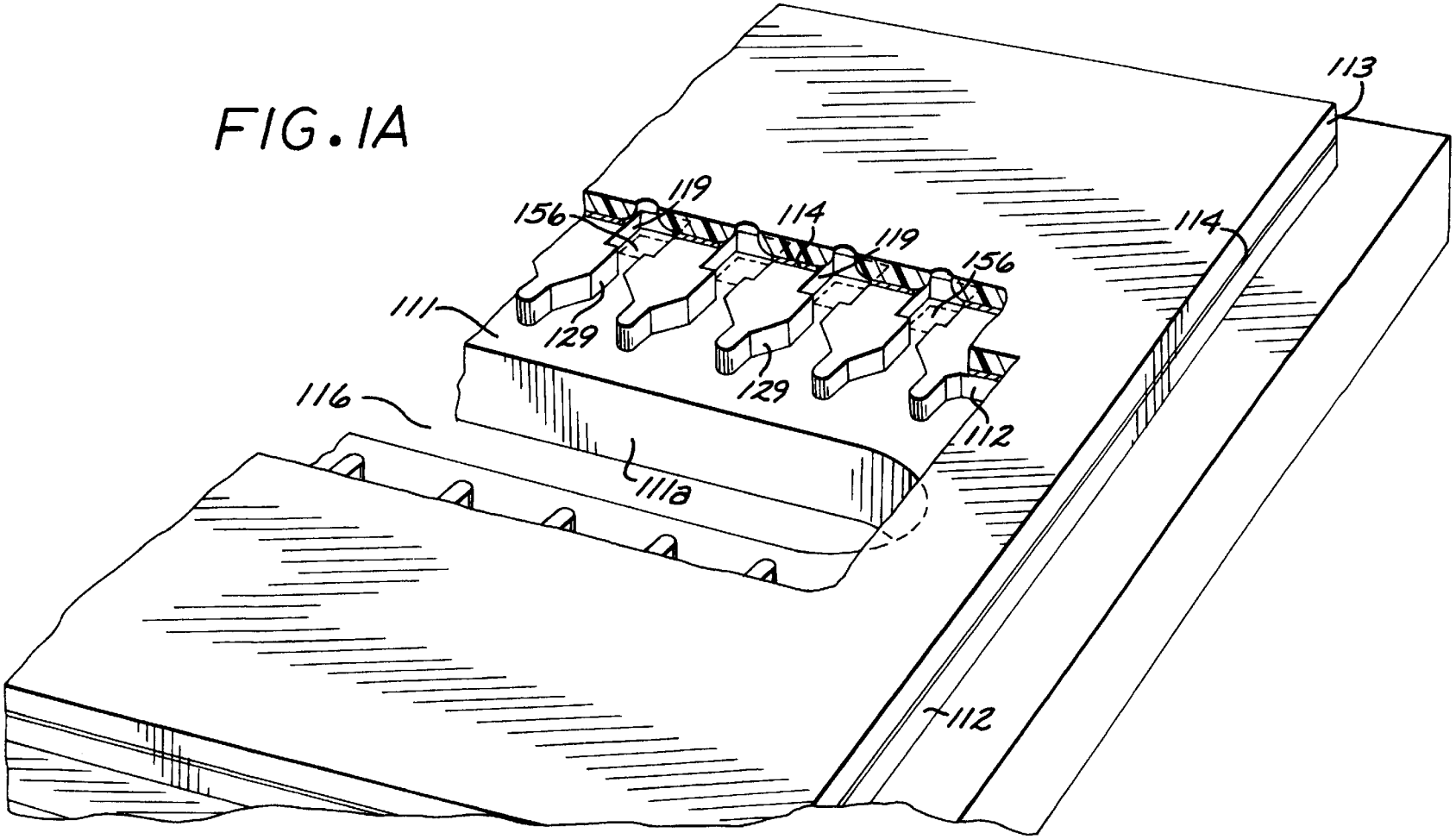
FIG. 1A is a schematic, partially sectioned perspective view of a further ink jet printhead in accordance with the invention.

The ink chambers 19 in the ink barrier layer 12 are more particularly disposed over respective ink firing resistors 56, and each ink chamber 19 is defined by the edge or wall of a chamber opening formed in the barrier layer 12. The ink channels 29 are defined by further openings formed in the barrier layer 12, and are integrally joined to respective ink firing chambers 19. By way of illustrative example, FIG. 1 illustrates an outer edge fed configuration wherein the ink channels 29 open towards an adjacent outer longitudinal edge 11*a* of the outer perimeter of the thin film substructure 11 and ink is supplied to the ink channels 29 and the ink chambers 19 around the outer longitudinal edges of the thin film substructure, for example as more particularly disclosed in commonly assigned U.S. Pat. No. 5,278,584, incorporated herein by reference, whereby the outer longitudinal edges 11*a* comprise feed edges. The invention can also be employed in a center edge fed ink jet printhead such as that disclosed in previously identified U.S. Pat. No. 5,317,346, and as schematically illustrated in FIG. 1A wherein ink channels 129 open towards an edge 111*a* formed by a slot 116 in the middle of the thin film substructure 111 in which heater resistors 156 are formed, whereby such edge comprises a feed edge. Similarly to the printhead of FIG. 1, the printhead of FIG. 1A includes an ink barrier layer 112, ink chambers 119, and an orifice plate 113 attached to the top of the ink barrier 112 with a silicon carbide adhesion layer 114.

The orifice plate 13 includes orifices 21 disposed over respective ink chambers 19, such that an ink firing resistor 56, an associated ink chamber 19, and an associated orifice 21 are aligned. An ink drop generator region is formed by each ink chamber 19 and portions of the thin film substructure 11 and the orifice plate 13 that are adjacent the ink chamber 19.

Figure 2:
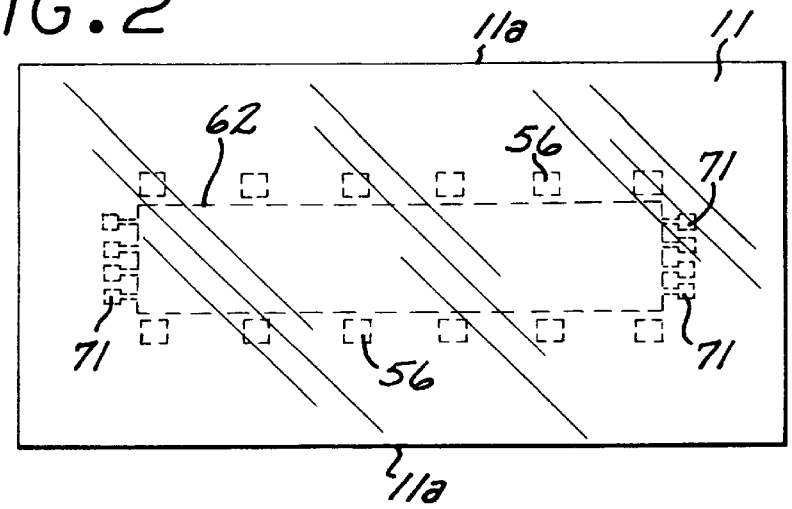
FIG. 2 is an unscaled schematic top plan illustration of the general layout of the thin film substructure of the ink jet printhead of FIG. 1.

Referring now to FIG. 2, set forth therein is an unscaled schematic top plan illustration of the general layout of the thin film substructure 11. The ink firing resistors 56 are formed in resistor regions that are adjacent the outer longitudinal edges 11*a* of the thin film substructure 11. A patterned gold layer 62 comprised of gold traces forms the top layer of the thin film structure in a gold layer region 162 located generally in the middle of the thin film substructure 11 between the resistor regions and extending between the ends of the thin film substructure 11. Bonding pads 71 for external connections are formed in the patterned gold layer 62, for example adjacent the ends of the thin film substructure 11. The ink barrier layer 12 is defined so as to cover all of the patterned gold layer 62 except for the bonding pads 71, and also to cover the areas between the respective openings that form the ink chambers and associated ink channels. Depending upon implementation, one or more thin film layers can be disposed over the patterned gold layer 62.

Figure 3:
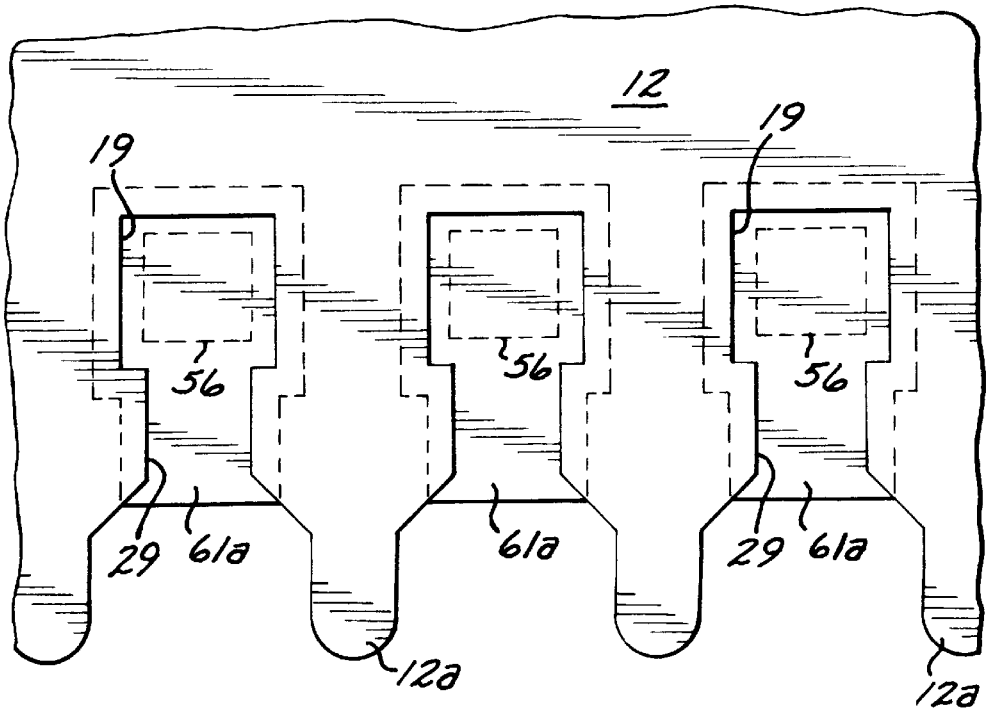
FIG. 3 is an unscaled schematic top plan view illustrating the configuration of a plurality of representative heater resistors, ink chambers and associated ink channels.
Figure 4:
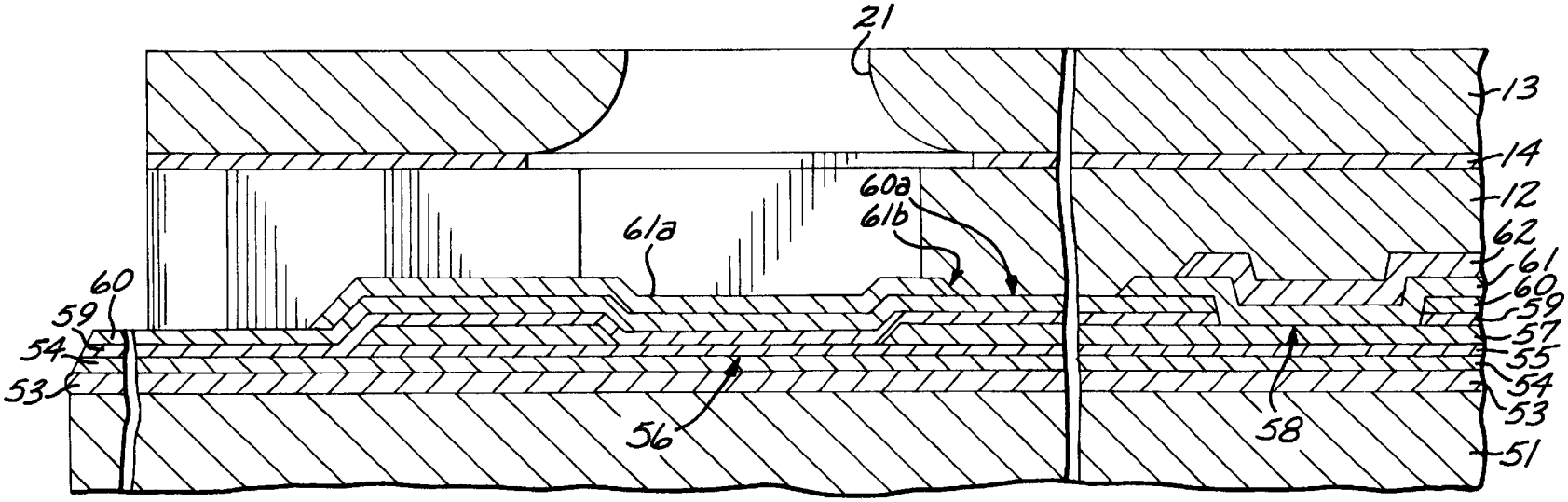
FIG. 4 is an unscaled schematic cross sectional view of the ink jet printhead of FIG. 1 taken laterally through a representative ink drop generator region and illustrating an embodiment of the printhead of FIG. 1.

Referring now to FIG. 3, set forth therein is an unscaled schematic top plan view illustrating the configuration of a plurality of representative heater resistors 56, ink chambers 19 and associated ink channels 29. As shown in FIG. 4, the heater resistors 56 are polygon shaped (e.g., rectangular) and are enclosed on at least two sides thereof by the wall of an ink chamber 19 which for example can be multi-sided. The ink channels 29 extend away from associated ink chambers 19 and can become wider at some distance from the ink chambers 19. Insofar as adjacent ink channels 29 generally extend in the same direction, the portions of the ink barrier layer 12 that form the openings that define ink chambers 19 and ink channels 29 thus form an array of barrier tips 12*a* that extend toward an adjacent feed edge of the thin film substructure 11 from a central portion of the barrier layer 12 that covers the patterned gold layer 62 and is on the side of the heater resistors 56 away from the adjacent feed edge. Stated another way, ink chambers 19 and associated ink channels 29 are formed by an array of side by side barrier tips 12*a* that extend from a central portion of the ink barrier 12 toward a feed edge of the thin film substructure 11.

The thin film substructure 11 includes a patterned tantalum layer 61 (FIG. 4) having tantalum layer islands or subareas 61*a* that are the topmost thin film layer over the heater resistors 56. The tantalum subareas 61*a* are located beneath respective ink chambers 19 and portions of the ink channels 19 adjacent associated ink chambers 29, so as to be at least in those areas that are subject to bubble collapse.

In accordance with the invention, as discussed more fully herein, the thin film substructure 11 includes a silicon carbide layer having increased contact with the ink barrier layer in the proximity of the ink chambers and the ink channels, and forming a silicon carbide polymer bond with the polymer ink barrier layer 12. Ideally, substantially all of the barrier layer in the vicinity of the ink chambers and the ink channels is in contact with silicon carbide. Further in accordance with the invention the thin film substructure 11 includes a silicon carbide layer having increased contact with the ink barrier layer in the proximity of the ink chambers and extending over most of the patterned gold layer. In accordance with another aspect of the invention, a silicon carbide layer 14 (FIG. 1) is laminated between the ink barrier layer 12 and the orifice plate 13.

It has been determined empirically that pressure and heat lamination of an interface between the ink barrier layer 12 and a silicon carbide layer provides a robust adhesion bond between the polymer ink barrier and the silicon carbide. A thin film adhesion promoter layer can optionally be disposed between the ink barrier layer and the silicon carbide layer. Thus, the invention contemplates in general an interface between a polymer ink barrier layer and a silicon carbide layer, either without an intervening thin film layer or with an intervening adhesion promoter layer. As to the interface between the thin film substructure 11 and the ink barrier layer 12, the interface between the ink barrier layer and the silicon carbide layer in the vicinity of the ink chambers and the ink channels is made as large as practicable, taking into account process limitations and the need to avoid exposed tantalum edges in the ink chambers which would cause detrimental pre-nucleation. For example, the silicon carbide/barrier interface extends from at least the gold layer region to the ends of the barrier tips 12*a*. As to the interface between the orifice plate 13 and the ink barrier layer 12, such interface extends over substantially all of the top surface of the ink barrier layer 12.

Referring now to FIG. 4, set forth therein is an unscaled schematic cross sectional view of the ink jet printhead of FIG. 1 taken through a representative ink drop generator region and a portion of the centrally located gold layer region 162, and illustrating a specific embodiment of the thin film substructure 11. The thin film substructure 11 of the ink jet printhead of FIG. 4 more particularly includes a silicon substrate 51, a field oxide layer 53 disposed over the silicon substrate 51, and a patterned phosphorous doped oxide layer 54 disposed over the field oxide layer 53. A resistive layer 55 comprising tantalum aluminum is formed on the phosphorous oxide layer 54, and extends over areas where thin film resistors, including ink firing resistors 56, are to be formed beneath ink chambers 19. A patterned metallization layer 57 comprising aluminum doped with a small percentage of copper and/or silicon, for example, is disposed over the resistor layer 55.

The metallization layer 57 comprises metallization traces defined by appropriate masking and etching. The masking and etch of the metallization layer 57 also defines the resistor areas. In particular, the resistive layer 55 and the metallization layer 57 are generally in registration with each other, except that portions of traces of the metallization layer 57 are removed in those areas where resistors are formed. In this manner, the conductive path at an opening in a trace in the metallization layer includes a portion of the resistive layer 55 located at the opening or gap in the conductive trace. Stated another way, a resistor area is defined by providing first and second metallic traces that terminate at different locations on the perimeter of the resistor area. The first and second traces comprise the terminal or leads of the resistor which effectively include a portion of the resistive layer that is between the terminations of the first and second traces. Pursuant to this technique of forming resistors, the resistive layer 55 and the metallization layer can be simultaneously etched to form patterned layers in registration with each other. Then, openings are etched in the metallization layer 57 to define resistors. The ink firing resistors 56 are thus particularly formed in the resistive layer 55 pursuant to gaps in traces in the metallization layer 57.

A composite passivation layer comprising a layer 59 of silicon nitride ($Si_3N_4$) and a layer 60 of silicon carbide (SiC) is disposed over the metallization layer 57, the exposed portions of the resistive layer 55, and exposed portions of the oxide layer 53. A tantalum passivation layer 61 is disposed on the composite passivation layer 59, 60 in areas that are subject to bubble collapse, and includes in particular islands or subareas 61*a* beneath ink chambers 19 and portions of associated ink channels 29 adjacent the ink chambers 19, as shown in plan view in FIG. 3. The tantalum passivation layer subareas 61*a* provide mechanical passivation to the ink firing resistors by absorbing the cavitation pressure of the collapsing drive bubble. The tantalum passivation layer 61 can also extend to areas over which the patterned gold layer 62 is formed for external electrical connections to the metallization layer 57 by conductive vias 58 formed in the composite passivation layer 59, 60.

In accordance with one aspect of the invention, the area of the interface or bond region 60*a* between the silicon carbide layer 60 and the ink barrier 12 is preferably maximized in the vicinity of the ink chambers 19 and the ink channels 29. For example, the silicon carbide/barrier interface extends from the region between the resistors 56 and the patterned gold layer 62 to the ends of the barrier tips 12*a*, and the tantalum subareas 61*a* are etched back as close as practicable, depending on process limitations, to the edges of the barrier layer 12 that form the ink chambers 19 and the ink channels while ensuring that edges 61*b* of the tantalum subareas 61*a* are outside the ink chambers 19. In other words, the tantalum subareas 61*a* beneath the ink chambers 19 and portions of the ink channels 29 (FIG. 3) extend beneath the ink barrier layer 12 adjacent the ink chambers 19 by a minimal amount that ensures that the edges of the tantalum subareas are outside the ink chambers 19. Thus, the tantalum passivation layer 61 is etched back as much as practicable adjacent the ink chambers 19 so as to extend by a minimal amount beneath the ink barrier layer 12 adjacent the ink chambers 19. For-example, the tantalum layer 61 is etched so that the subareas 61*a* extend at most approximately 8 microns beneath the ink barrier layer 12 adjacent the ink chambers 19. In this manner, the contact between the ink barrier layer 12 and the silicon carbide layer 60 is maximized in and around the vicinity of the ink chambers 19 and the ink channels 29, and in the vicinity of the ink chambers 19 and the ink channels 29 most of the ink barrier layer is bonded to silicon carbide.

By way of illustrative example, the tantalum is wet etched with a mixture of acetic, nitric and hydrofluoric acids to expose areas of the silicon carbide layer 60.

Figure 5:
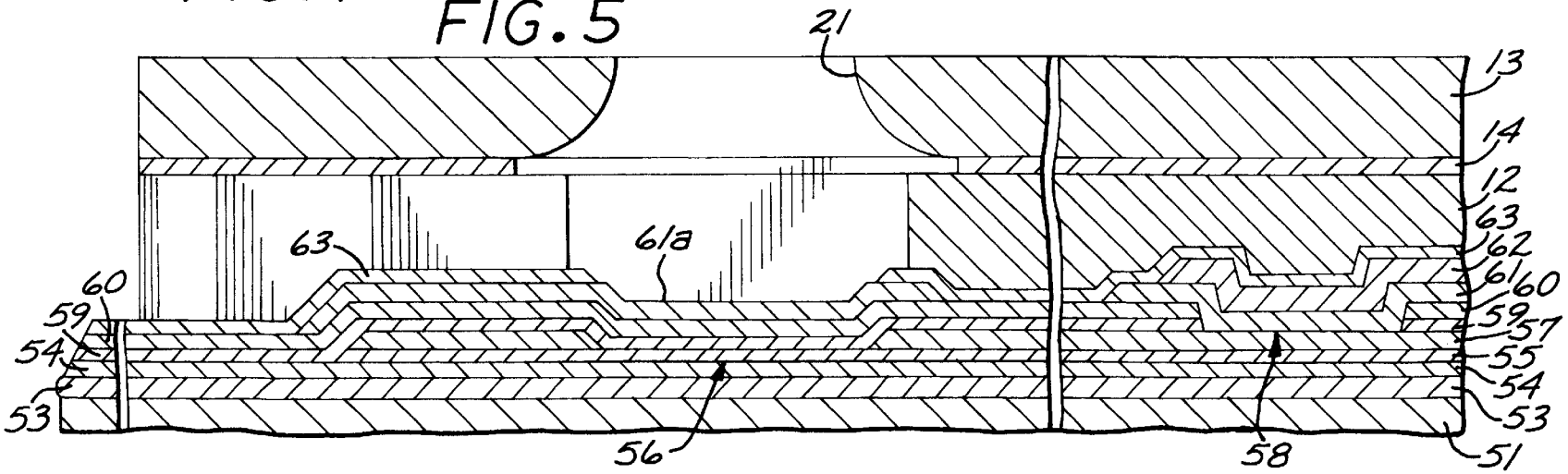
FIG. 5 sets forth an unscaled schematic cross sectional view of the ink jet printhead of FIG. 1 taken laterally through a representative ink drop generator region and illustrating another embodiment of the printhead of FIG. 1.

Referring now to FIG. 5, set forth therein is an unscaled schematic cross sectional view of the ink jet printhead of FIG. 1 taken laterally through a representative ink drop generator region and a portion of the patterned gold layer 62, and illustrating another specific embodiment of the an ink jet printhead in accordance with the invention. The ink jet printhead of FIG. 5 is substantially similar to the ink jet printhead of FIG. 4 with the addition of a silicon carbide overcoat layer 63 disposed as the topmost layer of the thin film substructure 11 in the vicinity of the ink chambers 19 and the ink channels 29, and as the topmost layer over the patterned gold layer 62, except for the region around the interconnect bonding pads 71. In particular, the silicon carbide overcoat layer 63 is etched from the areas of the tantalum layer subareas 61*a* that are over the heater resistors, such that the ink barrier layer 12 is in contact only with the silicon carbide layer 63 in the vicinity of and around the ink chambers 19 and the ink channels. In other words, the edges of the barrier layer that form the ink chambers 19 and the ink channels 20 are in contact with the silicon carbide layer 63, and not the tantalum layer 61.

By way of illustrative example, the silicon carbide overcoat layer 63 can be formed by plasma deposition using silane and methane as reactive gases. A suitable thickness of the silicon carbide layer would be at least about 100 Angstroms. The silicon carbide layer 63 can also be formed with reactive or non-reactive sputter deposition processes. An example of a reactive process is sputtering of a silicon target in a methane or other organic gas flow. An example of a non-reactive process is sputtering a silicon carbide target directly.

In the implementation of FIG. 5, the tantalum subareas can extend further from the ink chambers 19, since the silicon carbide overcoat layer 63 insures a barrier to silicon carbide interface immediately adjacent the ink chambers 19.

It is noted that surface analysis using X-ray photoelectron spectroscopy (XPS) of silicon carbide layers as implemented in accordance with the invention has indicated a relatively high concentration of carbon in carbide form as compared to tantalum and thermal oxide surfaces, and a relatively lower concentration of oxygen as compared to tantalum oxide and thermal oxide. The following table sets forth results from PHI Quantum 2000 XPS apparatus analyzed using a 100um photon beam rastered over a 500 $\mu$m by 500 $\mu$m area. Concentrations were determined by applying elemental sensitivity factors. Surfaces are listed with corresponding atomic concentrations of tantalum (Ta), silicon (Si), oxygen (O), and carbon (C). Carbon has been separated into non-carbide and carbide components. In cases where the sum of individual concentrations of Ta, Si, O and C is not equal to 100%, the difference is due to a small concentration of fluorine which has been omitted from the table for ease of understanding. The non-carbide component is adventitious carbon as distinguished from carbon incorporated as carbide, graphite, or diamond. Adventitious carbon can be either hydrocarbon or an oxidized hydrocarbon which is absorbed on the sample surface, and can be formed by exposure to atmospheric air.

| Sample | Ta | Si | O | C total | C non-carbide | C carbide |
|---|---|---|---|---|---|---|
| Ta | 28 | 0 | 58 | 13 | 13 | 0 |
| SiC (Ta wet etch) | 0 | 21 | 21 | 53 | 31 | 21 |
| SiC (Overcoat) | 0 | 34 | 12 | 53 | 8 | 45 |
| Thermal Oxide | 0 | 30 | 70 | 0 | 0 | 0 |

Adhesion testing by attempting to scrape and peel barrier material from a silicon carbide layer on a substrate has indicated excellent adhesion as compared to adhesion of barrier material to tantalum oxide (the interface of the barrier layer 12 to the tantalum layer 61 is actually to a tantalum oxide layer that forms on the tantalum layer as indicated by the foregoing XPS data) and as compared to thermal oxide. Accelerated long term ink soak durability testing and accelerated storage life testing of the adhesion of the ink barrier material to silicon carbide has indicated superior performance as compared to adhesion of barrier material to tantalum oxide and as compared to thermal oxide.

Figure 6:
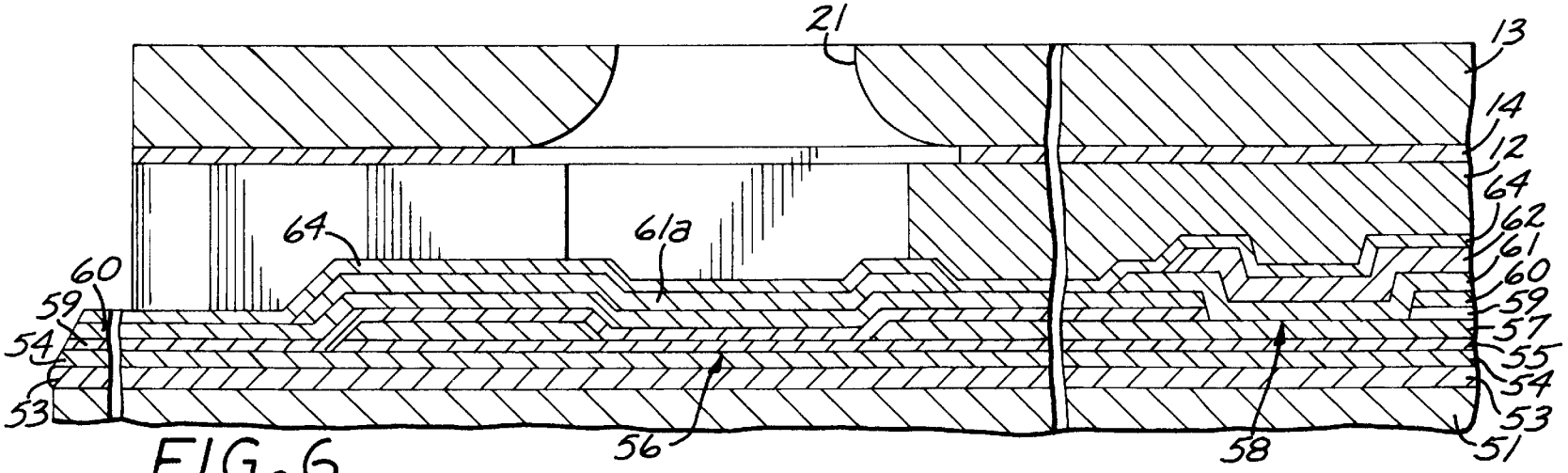
FIG. 6 is an unscaled schematic cross sectional view of the ink jet printhead of FIG. 1 taken laterally through a representative ink drop generator region and illustrating an embodiment of the printhead of FIG. 1 that is similar to the embodiment of FIG. 4 with the addition of an intervening adhesion promoter layer.
Figure 7:
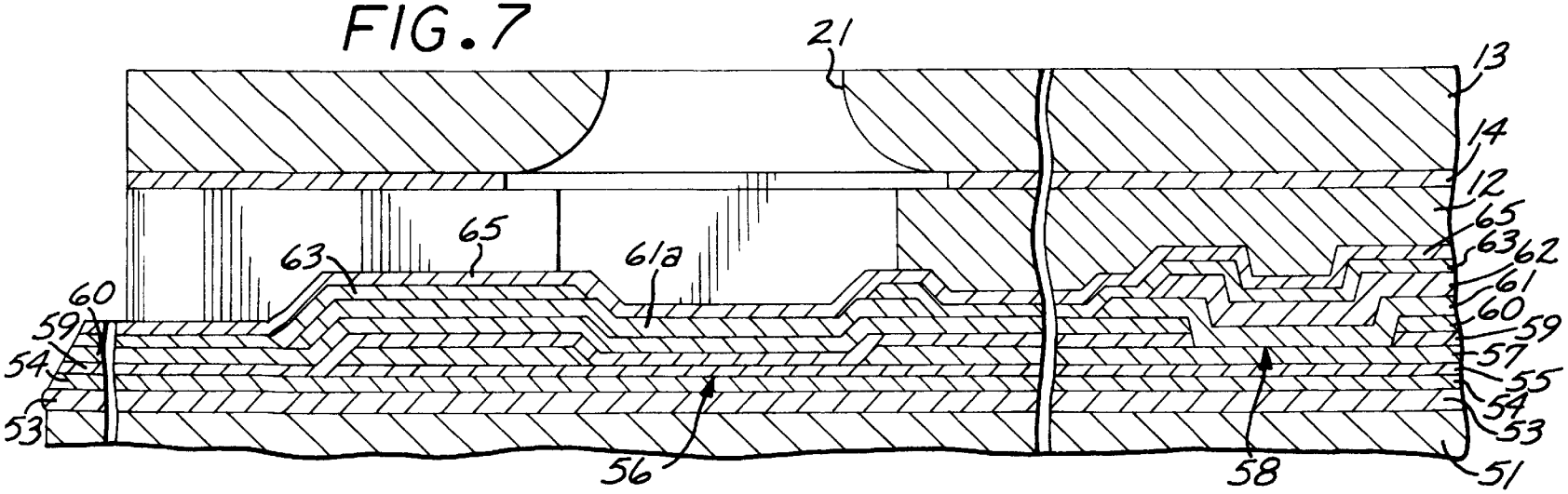
FIG. 7 sets forth an unscaled schematic cross sectional view of the ink jet printhead of FIG. 1 taken laterally through a representative ink drop generator region and illustrating an embodiment of the printhead of FIG. 1 that is similar to the embodiment of FIG. 5 with the addition of an intervening adhesion promoter layer.

The invention further contemplates an adhesion promoter layer located between the ink barrier layer 12 and the thin film substructures of FIGS. 4 and 5, as shown in FIGS. 6 and 7.

FIG. 6 particularly sets forth an unscaled schematic cross sectional view of the ink jet printhead of FIG. 1 taken laterally through a representative ink drop generator region and a portion of the centrally located gold layer region 162, and illustrating a further embodiment of the thin film substructure 11 that is similar to the structure of FIG. 4 with the addition of an intervening adhesion promoter layer 64 located between the silicon carbide layer 60 and the ink barrier layer 12.

FIG. 7 particularly sets forth an unscaled schematic cross sectional view of the ink jet printhead of FIG. 1 taken laterally through a representative ink drop generator region and a portion of the centrally located gold layer region 162, and illustrating an embodiment of the thin film substructure 11 that is similar to the structure of FIG. 5 with the addition of an adhesion promoter layer 65 located between the silicon carbide layer 63 and the ink barrier layer 12.

By way of illustrative example, the adhesion promoter layers 64, 65 comprise organosilane adhesion promoters, polyacrylic acid adhesion promoters, or polymethylacrylic acid adhesion promoters.

As to the silicon carbide layer 14 (FIG. 1) between the ink barrier layer 12 and the orifice plate 13, such silicon carbide layer 14 is formed on the orifice plate 13 prior to lamination to the thin film substructure 11 for example by plasma deposition using silane and methane as reactive gases. The silicon carbide layer 14 can also be formed with reactive or non-reactive sputter deposition processes. An example of a reactive process is sputtering of a silicon target in a methane or other organic gas flow. An example of a non-reactive process is sputtering a silicon carbide target directly.

Figure 8:
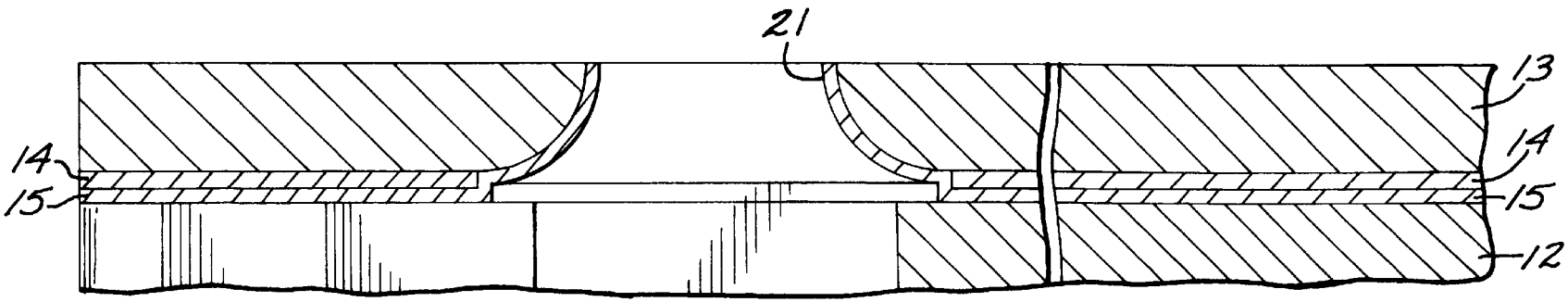
FIG. 8 sets forth an unscaled schematic cross sectional view of the ink jet printhead of FIG. 1 illustrating carbide and adhesion promoter bonding of the orifice plate.

For an implementation wherein the orifice plate 13 comprises a polymeric material, the silicon carbide layer 14 can be formed before or after formation of the orifices by laser ablation. Where the orifice plate 13 comprises a plated metal, the silicon carbide layer 14 is formed after forming the orifices. A suitable thickness of the silicon carbide layer would be at least about 100 Angstroms. As schematically illustrated in FIG. 8, an intervening adhesion promoter layer 15 can also be included between the silicon carbide layer 14 and the ink barrier 12.

The foregoing printhead is readily produced pursuant to standard thin film integrated circuit processing including chemical vapor deposition, photoresist deposition, masking, developing, and etching, for example as disclosed in commonly assigned U.S. Pat. No. 4,719,477 and U.S. Pat. No. 5,317,346, both previously incorporated herein by reference.

By way of illustrative example, the foregoing structures can be made as follows. Starting with the silicon substrate 51, any active regions where transistors are to be formed are protected by patterned oxide and nitride layers. Field oxide 53 is grown in the unprotected areas, and the oxide and nitride layers are removed. Next, gate oxide is grown in the active regions, and a polysilicon layer is deposited over the entire substrate. The gate oxide and the polysilicon are etched to form polysilicon gates over the active areas. The resulting thin film structure is subjected to phosphorous predeposition by which phosphorous is introduced into the unprotected areas of the silicon substrate. A layer of phosphorous doped oxide 54 is then deposited over the entire in-process thin film structure, and the phosphorous doped oxide coated structure is subjected to a diffusion drive-in step to achieve the desired depth of diffusion in the active areas. The phosphorous doped oxide layer is then masked and etched to open contacts to the active devices.

The tantalum aluminum resistive layer 55 is then deposited, and the aluminum metallization layer 57 is subsequently deposited on the tantalum aluminum layer 55. The aluminum layer 57 and the tantalum aluminum layer 55 are etched together to form the desired conductive pattern. The resulting patterned aluminum layer is then etched to open the resistor areas.

The silicon nitride passivation layer 59 and the SiC passivation layer 60 are respectively deposited. A photoresist pattern which defines vias to be formed in the silicon nitride and silicon carbide layers 59, 60 is disposed on the silicon carbide layer 60, and the thin film structure is subjected to overetching, which opens vias through the composite passivation layer comprised of silicon nitride and silicon carbide to the aluminum metallization layer.

Subsequent layers, including the tantalum passivation layer 61, any gold layer 62 for external connections, and any second silicon carbide layer 63 are suitably deposited and etched. As indicated earlier, the tantalum passivation layer is preferably wet etched to expose the silicon carbide layer 60. The ink barrier layer 12 is then heat and pressure laminated onto the thin film substructure. If desired, the adhesion promoter layer 64 is formed in accordance with conventional techniques prior to lamination of the ink barrier layer 12 onto the thin film substructure 11.

The silicon carbide layer 14 is formed on the orifice plate 13, and the orifice plate 13 with the silicon carbide layer 14 is laminated onto the laminar structure comprised of the silicon carbide layer 14, the ink barrier layer 12, and the thin film substructure 11. If desired, the adhesion promoter layer 15 is formed on the silicon carbide layer 14 in accordance with conventional techniques prior to lamination of the orifice plate 13.

The foregoing has thus been a disclosure of an ink jet printhead wherein robust ink barrier adhesion is effected by a silicon carbide layer.

Although the foregoing has been a description and illustration of specific embodiments of the invention, various modifications and changes thereto can be made by persons skilled in the art without departing from the scope and spirit of the invention as defined by the following claims.

What is claimed is:

1. A thin film ink jet printhead, comprising:

a thin film substrate including a plurality of thin film layers;

a plurality of ink firing heater resistors defined in said plurality of thin film layers;

a silicon carbide passivation layer disposed on said plurality of thin film layers over said ink firing heater resistors;

tantalum subareas disposed on said silicon carbide passivation layer over said plurality of ink firing heater resistors, said tantalum subareas respectively having edges;

an ink barrier layer disposed over said silicon carbide passivation layer and said tantalum subareas, said ink barrier layer and said silicon carbide passivation layer forming a carbide/barrier bond region between said barrier layer and said silicon carbide passivation layer;

respective ink chambers formed in said ink barrier layer over respective ink firing heater resistors and tantalum subareas, each chamber formed by a chamber opening in said barrier layer;

said tantalum subareas positioned such that said edges are as close as practicable to said ink chambers without being in said chambers, so that said carbide/barrier bond region in a vicinity of said ink chambers extends closely to the ink chambers; and an orifice plate disposed over said ink barrier layer.

2. The ink jet printhead of claim 1 wherein:

said ink firing heater resistors are arranged along a feed edge of said substrate;

said ink chambers are formed by barrier tips that extend between ink firing heater resistors toward said feed edge from a region on a side of the ink firing heater resistors opposite said feed edge; and said carbide/barrier bond region extends along said barrier tips from said region on a side of the ink firing heater resistors opposite said feed edge.

3. The ink jet printhead of claim 2 wherein said feed edge comprises an outer edge of said substrate.

4. The ink jet printhead of claim 2 wherein said feed edge is formed by a slot in the middle of said substrate.

5. The ink jet printhead of claim 1 wherein said tantalum subareas extend laterally beneath said ink barrier layer adjacent said ink chambers by no more than about 8 microns.

6. The ink jet printhead of claim 1 further including an adhesion promoter layer disposed between said silicon carbide passivation layer and said ink barrier layer.

7. The ink jet printhead of claim 1 wherein said carbide/barrier bond region extends to within 8 microns of said ink chambers.

8. A thin film ink jet printhead, comprising:

a thin film substrate including a plurality of thin film layers;

a plurality of ink firing heater resistors defined in said plurality of thin film layers;

a silicon carbide passivation layer disposed on said plurality of thin film layers over said ink firing heater resistors;

tantalum subareas disposed on said silicon carbide passivation layer over said plurality of ink firing heater resistors, said tantalum subareas respectively having edges;

a silicon carbide overcoat layer disposed over said silicon carbide passivation layer and said tantalum subareas and having openings over said ink firing heater resistors;

an ink barrier layer disposed over said silicon carbide overcoat layer and said tantalum subareas, said ink barrier layer and said silicon carbide overcoat layer forming a carbide/barrier bond region between said ink barrier layer and said silicon carbide overcoat layer;

respective ink chambers formed in said ink barrier layer over respective ink firing heater resistors, each chamber formed by a chamber opening in said barrier layer;

said silicon carbide overcoat layer positioned such that said carbide/barrier bond region in a vicinity of said ink chambers extends to said ink chambers; and an orifice plate disposed over said ink barrier layer.

9. The ink jet printhead of claim 8 wherein:

said ink firing heater resistors are arranged along a feed edge of said substrate;

said ink chambers are formed by barrier tips that extend between ink firing heater resistors toward said feed edge from a region on a side of the ink firing heater resistors opposite said feed edge; and said carbide/barrier bond region extends along said barrier tips from said region on a side of the ink firing heater resistors opposite said feed edge.

10. The ink jet printhead of claim 9 wherein said feed edge comprises an outer edge of said substrate.

11. The ink jet printhead of claim 9 wherein said feed edge is formed by a slot in the middle of said substrate.

12. The ink jet printhead of claim 8 further including an adhesion promoter layer disposed between said silicon carbide overcoat layer and said ink barrier layer.

13. A thin film ink jet printhead, comprising:

a thin film substrate including a plurality of thin film layers;

a plurality of ink firing heater resistors defined in said plurality of thin film layers;

a silicon carbide overcoat layer disposed on said plurality of thin film layers and having openings over said ink firing heater resistors;

an ink barrier layer disposed over said silicon carbide overcoat layer, said ink barrier layer and said silicon carbide overcoat layer forming a carbide/barrier bond region between said ink barrier layer and said silicon carbide overcoat layer;

respective ink chambers formed in said ink barrier layer over respective ink firing heater resistors, each chamber formed by a chamber opening in said barrier layer;

said silicon overcoat layer positioned such that said carbide/barrier bond region in a vicinity of said ink chambers extends to said ink chambers; and an orifice plate disposed over said ink barrier layer.

14. The ink jet printhead of claim 13 wherein:

said ink firing heater resistors are arranged along a feed edge of said substrate;

said ink chambers are formed by barrier tips that extend between ink firing heater resistors toward said feed edge from a region on a side of the ink firing heater resistors opposite said feed edge; and said carbide/barrier bond region extends along said barrier tips from said region on a side of the ink firing heater resistors opposite said feed edge.

15. The ink jet printhead of claim 14 wherein said feed edge comprises an outer edge of said substrate.

16. The ink jet printhead of claim 14 wherein said feed edge is formed by a slot in the middle of said substrate.

17. The ink jet printhead of claim 13 further including an adhesion promoter layer disposed between said silicon carbide overcoat layer and said ink barrier layer.

18. A thin film ink jet printhead, comprising:

a thin film substrate including a plurality of thin film layers;

a plurality of ink firing heater resistors defined in said plurality of thin film layers;

a silicon carbide passivation layer disposed on said plurality of thin film layers over said ink firing heater resistors;

tantalum subareas disposed on said silicon carbide passivation layer over said plurality of ink firing heater resistors, said tantalum subareas respectively having edges;

an ink barrier layer disposed over said silicon carbide passivation layer and said tantalum subareas, said ink barrier layer and said silicon carbide passivation layer forming a carbide/barrier bond region between said barrier layer and said silicon carbide passivation layer;

respective ink chambers formed in said ink barrier layer over respective ink firing heater resistors and tantalum subareas, each chamber formed by a chamber opening in said barrier layer;

said tantalum subareas positioned such that said edges are as close as practicable to said ink chambers without being in said chambers, so that said carbide/barrier bond region in a vicinity of said ink chambers extends closely to the ink chambers;

an orifice plate disposed over said ink barrier layer; and a silicon carbide adhesion layer disposed between said ink barrier layer and said orifice plate.

19. The ink jet printhead of claim 18 further including an adhesion promoter layer disposed between said silicon carbide adhesion layer and said ink barrier layer.

20. The inkjet printhead of claim 18 further including an adhesion promoter layer disposed between said silicon carbide passivation layer and said ink barrier layer.

21. A thin film ink jet printhead, comprising:

a thin film substrate including a plurality of thin film layers;

a plurality of ink firing heater resistors defined in said plurality of thin film layers;

a silicon carbide passivation layer disposed on said plurality of thin film layers over said ink firing heater resistors;

tantalum subareas disposed on said silicon carbide passivation layer over said plurality of ink firing heater resistors, said tantalum subareas respectively having edges;

a silicon carbide overcoat layer disposed over said silicon carbide passivation layer and said tantalum subareas and having openings over said ink firing heater resistors;

an ink barrier layer disposed over said silicon carbide overcoat layer and said tantalum subareas, said ink barrier layer and said silicon carbide overcoat layer forming a carbide/barrier bond region between said ink barrier layer and said silicon carbide overcoat layer;

respective ink chambers formed in said ink barrier layer over respective ink firing heater resistors, each chamber formed by a chamber opening in said barrier layer;

said silicon carbide overcoat layer positioned such that said carbide/barrier bond region in a vicinity of said ink chambers extends to said ink chambers; and an orifice plate disposed over said ink barrier layer; and a silicon carbide adhesion layer disposed between said ink barrier layer and said orifice plate.

22. The ink jet printhead of claim 21 further including an adhesion promoter layer disposed between said silicon carbide adhesion layer and said ink barrier layer.

23. The ink jet printhead of claim 21 further including an adhesion promoter layer disposed between said silicon carbide passivation layer and said ink barrier layer.

24. A thin film ink jet printhead, comprising:

a thin film substrate including a plurality of thin film layers;

a plurality of ink firing heater resistors defined in said plurality of thin film layers;

a silicon carbide overcoat layer disposed on said plurality of thin film layers and having openings over said ink firing heater resistors;

tantalum subareas disposed between said ink firing heater resistors and said silicon carbide overcoat layer;

an ink barrier layer disposed over said silicon carbide overcoat layer, said ink barrier layer and said silicon carbide overcoat layer forming a carbide/barrier bond region between said ink barrier layer and said silicon carbide overcoat layer;

respective ink chambers formed in said ink barrier layer over respective ink firing heater resistors, each chamber formed by a chamber opening in said barrier layer;

said silicon overcoat layer positioned such that said carbide/barrier bond region in a vicinity of said ink chambers extends to said ink chambers; and an orifice plate disposed over said ink barrier layer.

25. A thin film ink jet printhead, comprising:

a thin film substrate including a plurality of thin film layers;

a plurality of ink firing heater resistors defined in said plurality of thin film layers;

a silicon carbide overcoat layer disposed on said plurality of thin film layers and having openings over said ink firing heater resistors;

an ink barrier layer disposed over said silicon carbide overcoat layer, said ink barrier layer and said silicon carbide overcoat layer forming a carbide/barrier bond region between said ink barrier layer and said silicon carbide overcoat layer;

respective ink chambers formed in said ink barrier layer over respective ink firing heater resistors, each chamber formed by a chamber opening in said barrier layer;

said silicon overcoat layer positioned such that said carbide/barrier bond region in a vicinity of said ink chambers extends to said ink chambers;

an orifice plate disposed over said ink barrier layer; and a silicon carbide adhesion layer disposed between said ink barrier layer and said orifice plate.

26. The ink jet printhead of claim 25 further including an adhesion promoter layer disposed between said silicon carbide adhesion layer and said ink barrier layer.

27. The ink jet printhead of claim 25 further including an adhesion promoter layer disposed between said silicon carbide overcoat layer and said ink barrier layer.

* * * * *